United States Patent [19]

Benson et al.

[11] Patent Number: 4,626,224

[45] Date of Patent: Dec. 2, 1986

[54] SLOWLY APPEARING, RAPIDLY DISAPPEARING FIGURE TOY

[75] Inventors: John T. Benson, Canoga Park; William Hart, Palos Verdes Estates; Jerome F. Stratman, Cypress, all of Calif.

[73] Assignee: Mattel, Inc., Hawthorne, Calif.

[21] Appl. No.: 742,160

[22] Filed: Jun. 6, 1985

[51] Int. Cl.[4] ..... A63H 3/28; A63H 13/00

[52] U.S. Cl. ..... 446/297; 446/308

[58] Field of Search ..... 446/272, 274, 280, 281, 446/282, 283, 284, 297, 298, 300, 308, 309, 310

[56] References Cited

U.S. PATENT DOCUMENTS

| | | | |
|---|---|---|---|
| 233,166 | 10/1880 | Rose | 446/310 |
| 847,715 | 3/1907 | Wood | 446/310 |
| 996,416 | 6/1911 | Kusnell | 446/310 |
| 1,236,087 | 8/1917 | Irwin | 446/310 X |
| 1,354,381 | 9/1920 | Dayon | 446/284 |
| 1,558,329 | 10/1925 | Assendrup | 446/310 X |
| 1,590,519 | 6/1926 | Jones | 446/310 |
| 2,263,662 | 11/1941 | Waper | 446/310 X |
| 2,419,872 | 4/1947 | Beder | 446/282 |
| 2,534,631 | 12/1950 | Simpson | 446/310 |
| 2,559,201 | 7/1951 | Schy et al. | 446/120 |
| 2,617,232 | 11/1952 | Simpson | 446/310 |
| 2,724,925 | 11/1955 | Fisher et al. | 446/281 |
| 3,119,201 | 1/1964 | Brown et al. | 446/245 |
| 3,475,848 | 11/1969 | Gruber | 446/3 |
| 3,691,675 | 9/1972 | Rodgers | 446/118 |
| 4,453,339 | 6/1984 | Cook | 446/227 |
| 4,573,654 | 3/1986 | Nottingham | 446/227 X |

FOREIGN PATENT DOCUMENTS

| | | | |
|---|---|---|---|
| 416058 | 7/1925 | Fed. Rep. of Germany | 446/310 |

*Primary Examiner*—F. Barry Shay

*Attorney, Agent, or Firm*—Ronald M. Goldman; Melvin A. Klein

[57] ABSTRACT

A toy including a figure adapted to be moved slowly from a lowered position in which the figure is concealed behind a portion of a housing to a raised position in which the figure is visible and to be moved rapidly from its raised position to the lowered position. The mechanism moving the figure is driven by a music box and includes a post supporting the figure, a pin fixed to the post, an actuating arm having an aperture at one end in which the pin is loosely engaged and being secured to a housing at its other end. The means driven by the music box to cause the arm to reciprocate between the raised and lowered positions, also rotates the figure about a verticle axis.

6 Claims, 6 Drawing Figures

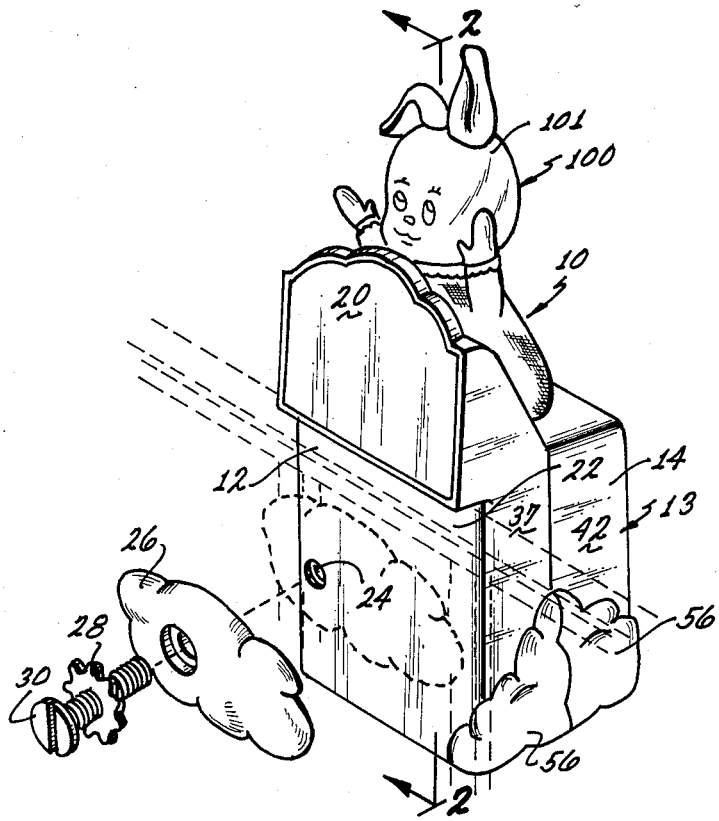
FIG. 1
FIG. 4
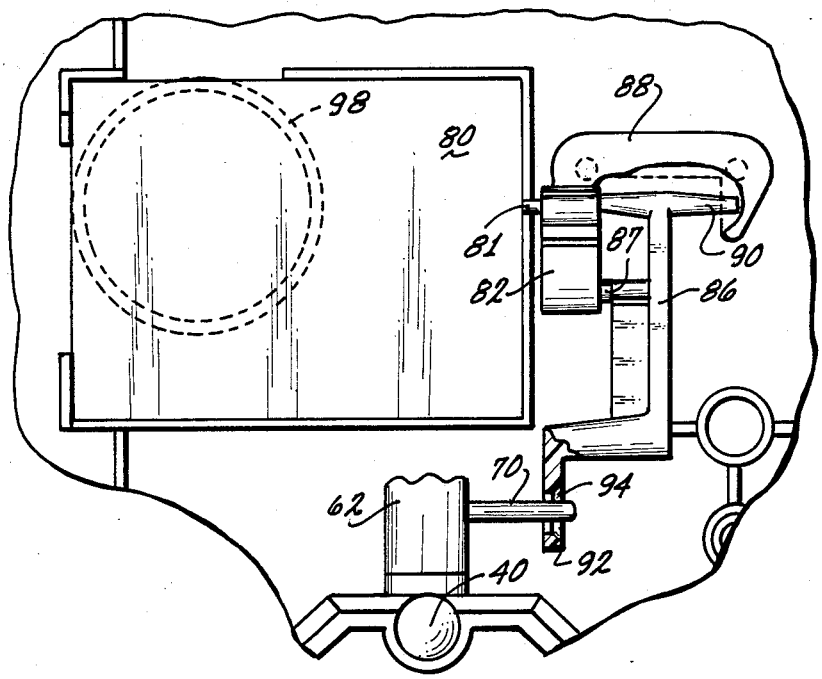

103
101
12
58
20
105
100
10
18
60
50
16
13
14
83
85
80
22
89
4
98
88
81
90
26
28
82
86
30
84
93
24
32
36
64
40
34
92
66
70
84b
36'
99
80

SLOWLY APPEARING, RAPIDLY DISAPPEARING FIGURE TOY

BACKGROUND OF THE INVENTION

1. TECHNICAL FIELD

This invention relates generally to an animated toy and more particularly to a toy figure powered by a music box.

2. BACKGROUND ART

There are many toys in which a figure is made to move, or appear and disappear. Examples of such toys are shown in U.S. Pat. No. 2,559,201, which shows a motor actuated display figure; U.S. Pat. No. 3,119,201, which shows an animated toy that moves in and out of a receptacle by an acoustically responsive control means; and U.S. Pat. No. 3,475,848, which discloses a coin operated device, in the form of a house wherein a figurine moves outwardly to cause the disappearance of a coin placed on the porch of the house.

Other toys in which a figure is made to appear and disappear, are of the jack-in-the-box type. An example of such a toy is shown in U.S. Pat. No. 3,691,675, which discloses a jack-in-the-box equipped with a bellows attached between the moveable figure and the box, to cause a noise when the box is operated.

Such prior art devices have very limited appeal because of the rapidity with which the appearance and disappearance of the figure is effected, or because of the way they are operated, and/or constructed. In contrast to the prior art devices, the movements imparted to the figure in the present invention are intended to increase the child's interest in the toy.

DISCLOSURE OF THE INVENTION

In accordance with the present invention a figure toy is provided having a hollow outer shell within which a mechanism is provided to move the figure slowly from a place of concealment to a position in which it is visible and then to cause it to be returned quickly to its original place of concealment. The mechanism is preferably actuated by a music box which plays music as the figure moves, and which may be related to the movement of the figure. Thus, when the figure is caused to emerge slowly from its place of concealment the music box may play slow music, and when it is caused to disappear from sight quickly, the music box may play faster music.

In a preferred embodiment, the figure is a bunny and the movement imparted to the bunny includes both a vertical movement and a rotational movement in which the bunny is turned from side to side.

Further objects, features and advantages of the invention will become apparent upon reading the following description when taken in conjunction with the attached drawings.

BRIEF DESCRIPTION OF THE DRAWINGS

FIG. 1 is a partially exploded perspective view of the toy of this invention;

FIG. 4 is a fragmentary schematic view taken on plane 4—4 of FIG. 2;

BEST MODE FOR CARRYING OUT THE INVENTION

Figures 2, 5:
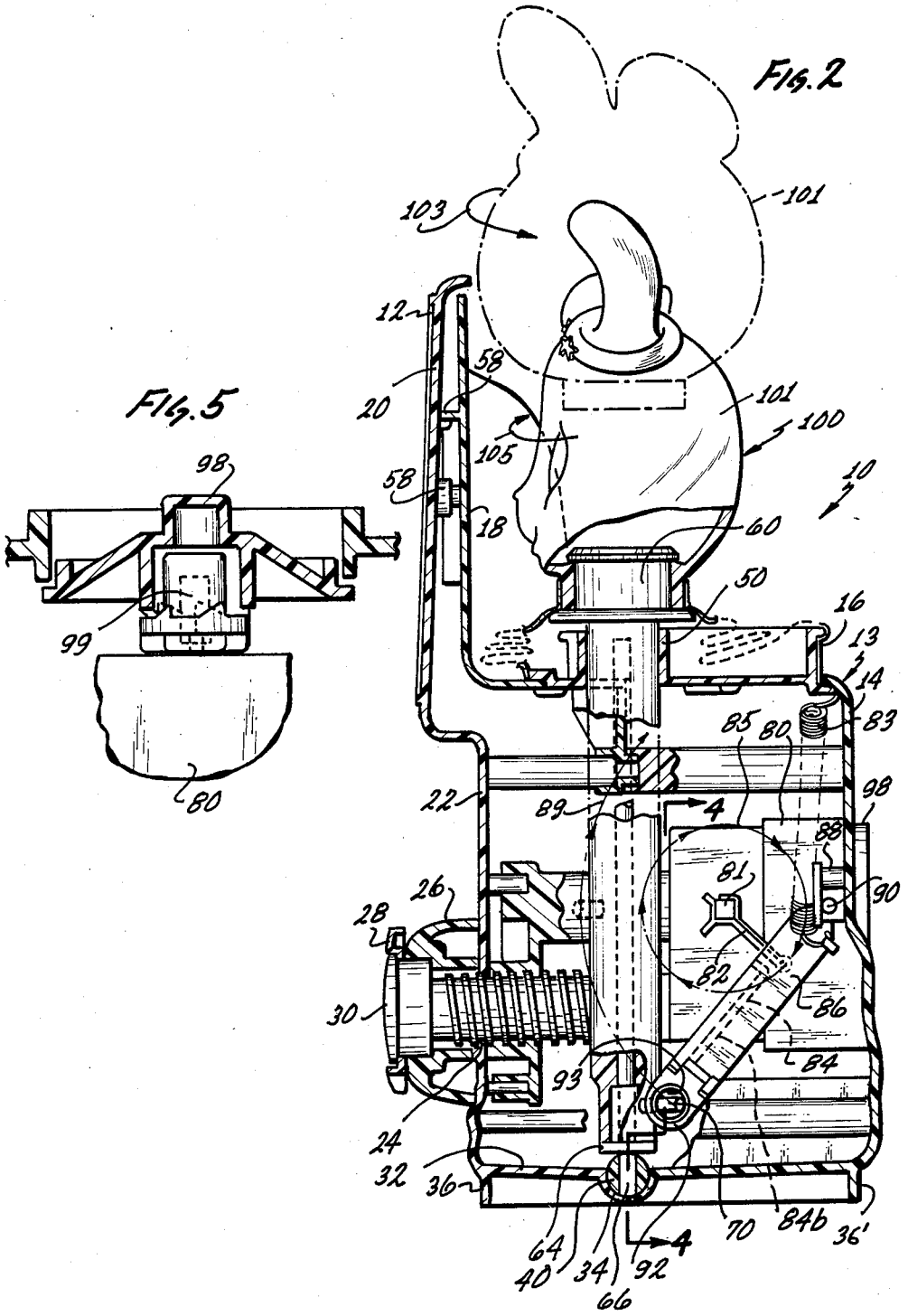
FIG. 2 is a view partly in section taken on plane 2—2 of FIG. 1 showing the operating mechanism of the toy with the figure down.
FIG. 5 is a view partly in section showing the actuating knob for the music box in greater detail.

The toy of the present invention, indicated by the numeral 10, comprises a housing 13 consisting of a front section 12, a rear section 14 and two top housing sections 16, 18, each of which is preferably molded of synthetic resin.

The front housing 12 includes an upwardly extending proscenium shaped upper wall 20 behind which a bunny or other figure 100 is substantially or partly concealed when the figure is in its lowermost position (see FIG. 2). A lower wall 22 extends downwardly from upper wall 20 and includes a threaded aperture 24 adapted to receive a screw 30 which holds a front clamp 26 to front wall 22. A washer 28 is provided to assist in holding clamp 26 and therefore the entire toy 10 to a crib rail 25, or the like, when the screw 30 is tightened.

The front housing 12 also includes a generally horizontal bottom wall 32 (FIGS. 2 and 3) having a hemispherical recess 34 adapted to receive a ball 40. If the toy 10 is not mounted on a crib or the like, foot 36 may be used to support the front housing an appropriate height above a surface on which the toy is placed. Front housing 12 also has side walls 37 extending rearwardly from front wall 22.

A complementary hemispherical recess 38 is provided in the base portion of rear housing 14. Therefore, the two recesss 34 and 38 define a ball shaped socket adapted to receive ball 40. The rear housing 14 has forwardly extending side walls 42, with a foot 361, similar to foot 36.

The front housing 12 and rear housing 14 may be secured to one another by screws or other fastening means so as to define an enclosure for the working mechanism of the toy.

Top housing section 16 is provided with an upwardly opening aperture 50 which receives the support for the figure 100. Top housing section 18 is provided with fingers or flanges 58 which engage similar structures on the rear surface of front wall 20 and reinforce it. Additional ornamentation 56 resembling clouds or hills may be secured to the lower front wall 22, and sidewalls 37 and 42.

The figure 100, preferably has a head 101, in the shape of a bunny or the like, supported on a top bearing 60 received in a recess in the top of a hollow cylindrical post 62, further supported on a bottom bearing 64 (FIG. 2). An upwardly extending shaft 66 extends through the hollow post 62. Shaft 66 is supported by and extends into a hole in ball 40. A guide pin 70 is secured to cylindrical post 62 near the lower end thereof, so that as post 62 moves up and down, the head or figure 100 may rotate from side to side as it is moved, as explained below. A gown or other body shape 102, is hung from a collar on post 62 to hide the post when it is raised.

Figure 3:
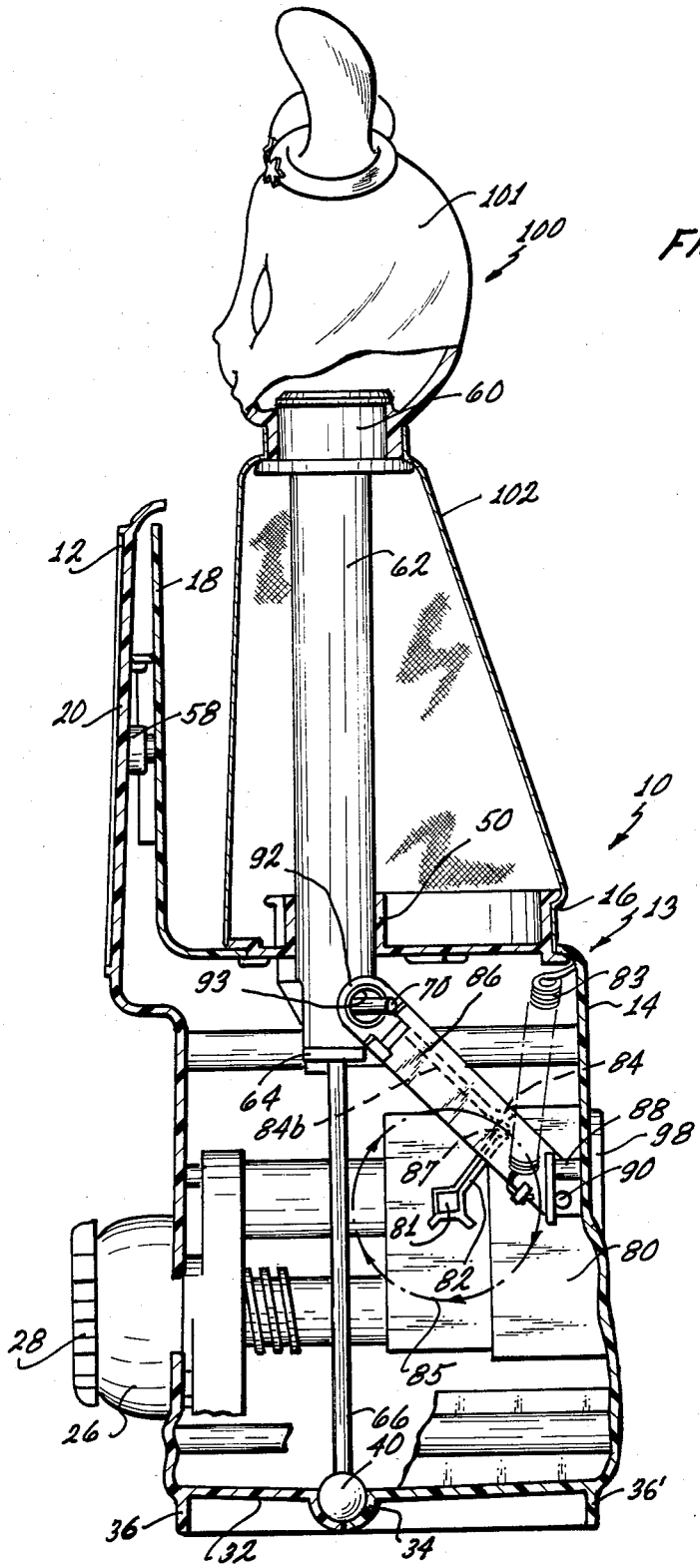
FIG. 3 is a view similar to FIG. 2 with the figure raised.

As best seen in FIGS. 2 and 3, rear housing 14 is provided with a mechanism which causes the figure 100 to rise slowly from the position shown in FIG. 2, behind the top wall 20 to the raised position shown in FIG. 3, and to return quickly to the lowered position shown in FIG. 2.

This mechanism includes a music box unit 80 having an output shaft 81 which drives a crank arm 82, which in turn operates an actuator arm 86, biased to one position by a spring 83. Shaft 81 rotates the crank arm 82 so that it engages with the bottom of a depression 84 formed in the actuator arm 86 during a portion of the rotation of the crank arm. A first end of the actuator arm 86 is secured to a holding means, such as a clamp 88 (FIGS. 2 and 4), by means of a pin 90 attached to or formed at the first end thereof. When the music box operates, output shaft 81 rotates crank arm 82, which then causes the actuator arm 86 to move through an arc or reciprocate between the raised or up position of FIG. 3 and the down or lowered position of FIG. 2.

OPERATION

The music box drive is actuated by a winding button or handle 98 (FIG. 5) which is connected to the music unit through a clutch 99 in the usual manner. After turning the knob or handle 98 to wind the music box and actuate output shaft 81, the toy of the present invention operates as follows:

The crank arm 82 is rotated by the output shaft 81 in either direction, but preferably in the clockwise direction, as indicated by arrows 85, in FIGS. 2 and 3. The crank arm 82 includes an extending finger 87 (see FIG. 4) which contacts the bottom portion 84B of depression 84 during approximately two-thirds (240 degrees) of the rotation of the crank arm. During this period of contact, the crank arm acts against the bias of spring 83 to slowly move the actuator arm 86 from the downward or lowered position shown in FIG. 2 to the raised or upward position shown in FIG. 3. This slow upward motion or reciprocation of actuator arm 86 through an arc, as shown by arrow 89, moves post 62 and therefore the figure 100 from the lowered position (solid line in FIG. 2) to the raised position (shown in solid line in FIG. 3 and in broken line in FIG. 2). When the crank arm reaches the position shown in FIG. 3, the finger 87 will pass by the rounded end of the bottom 84B, therefore allowing the combined weight of the figure 100, the post 62 and portions of the operating mechanism to quickly return the figure 100 and actuator arm 86 to the lowered position (FIG. 3). The weight of these items is carefully selected to provide the desired quick, downward movement. The downward movement of the actuator arm also stretches or tensions the spring 83. At the same time, the crank arm continues to rotate by operation of the output shaft 81. When the crank arm reaches the approximate position shown in FIG. 2 (approximately one-third or 120 degrees of rotation later) it is in position for the finger 87 to again contact the bottom surface 84B of depression 84 to again start the upward movement of actuator arm 86 and figure 100, as explained above.

The spring 83 is provided to assist the contact of finger 87 with bottom surface 84B and, therefore, the slow movement of the figure 100 from its lowered position to its raised position. One end of spring 83 is secured in any convenient manner to the top portion of back housing 14, while the other end is secured to an arm formed adjacent the first end of actuator arm 86 held in clamp means 88.

To add further novelty and enjoyment value to the toy 10, the actuator arm 86 has a second end 92 with an enlarged opening 93 which is loosely connected to post 62 through drive pin 70 which extends through the opening 93. When the actuator arm 86 swings up or down, the post 62 and the figure 100 on the top of the post are caused to rotate back and forth, in the direction of arrows 103, 105 (FIG. 2), about a vertical axis. The loose fit of pin 70 in the aperture 93 of the actuator arm aids in the oscillation or rotation of the figure as the actuator arm moves slowly up and quickly down, through the arc, as shown by arrow 89.

Figure 6:
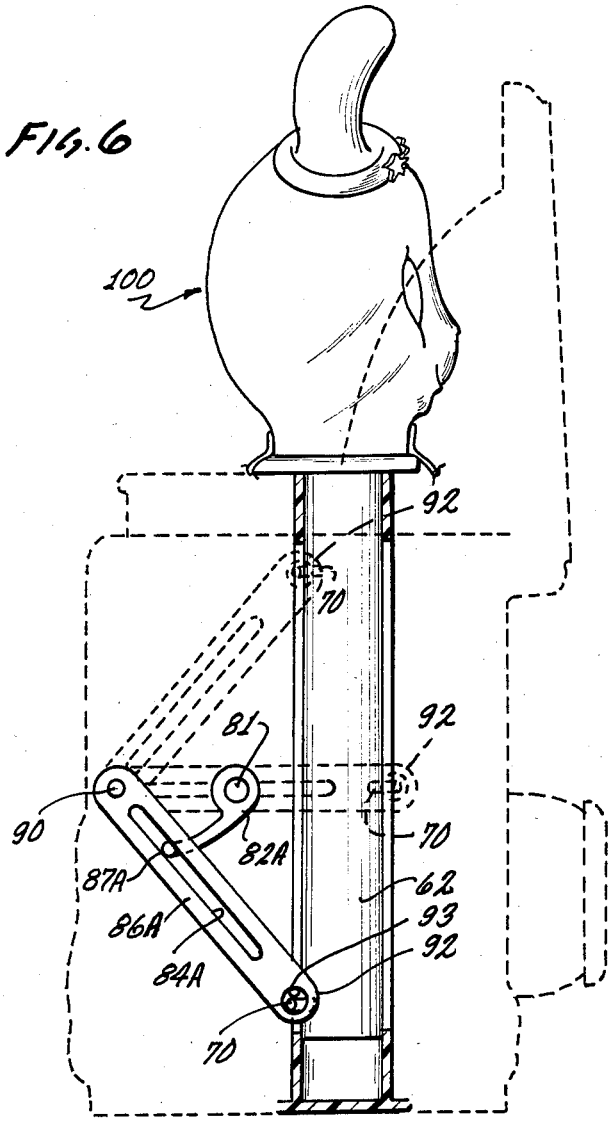
FIG. 6 is a view partly in section showing a second embodiment of the operating mechanism, with the figure lowered.

In a further embodiment of the driving or operating mechanism of the invention as shown in FIG. 6, an actuator arm 86A and a crank arm 82A have been changed, while the remaining parts are substantially the same. The actuator arm 86A includes a slot 84A in which a finger 87A of crank arm 82A is held for sliding movement.

In this embodiment, the music box unit 80 output shaft 81 also rotates the crank arm 82A. If desired, a biasing means, such as spring 83 may also be used. The first end of the actuator arm 86A is also secured to the clamp portion 88 so as to be pivotable about a pin 90A. When the crank arm 82A rotates the actuator arm 86A is reciprocated by action of the finger 87A sliding in slot 84A. During upward movement of the actuator arm 86A the engagement point of the finger 87A of crank arm 82A in the slot is at its furthest distance from the actuator arm center causing a slow upward travel. When the actuator arm 86A is on its downward travel the engagement point with the crank arm 82A is at its closest distance from the actuator arm center thereby causing a fast downward motion.

Although the toy has been described as one which may stand on any flat surface, or be clamped to any supporting surface such as the back of a chair or the rail of a crib, other pieces of children's furniture or the like for supporating it may be provided without departing from the invention.

While the particular toy shown and described in detail herein is fully capable of attaining the objects and providing the advantages above stated, it is to be understood that it is merely illustrative of the presently preferred embodiment of the invention. No limitations are intended in the details of the construction or design shown, other than as defined in the attached claims, which form a part of this disclosure.

The term "means", as employed in the claims is to be interpreted as defining the corresponding structure illustrated and described in the specification or the equivalent thereof.

We claim:

1. An action figure toy comprising:

a figure;

a housing including means to conceal the figure;

means connecting said figure to said housing for relative movement from a position of concealment of said figure to one of visibility of said figure;

means to move said figure slowly from said position of concealment to said position of visibility and to return it rapidly to said position of concealment;

wherein the connecting means includes a post supporting said figure in said housing, a pin fixed to said post, an actuating arm mounted on said housing having a first end connected loosely to said pin, and means mounted on said housing to move said actuating arm about a pivot fixed to said housing and located adjacent a second end of said arm;

wherein the means to move said arm includes a crank, one end of which crank engages said arm and the other end of which engages a motor-driven music box;

wherein said arm includes a slot and said crank includes a finger which engages said slot whereby upon actuation of said music box said crank will drive said arm to thereby move said figure.

2. The toy of claim 1 wherein said figure both reciprocates and rotates as it is moved.

3. The toy of claim 2 including clamp means for securing said toy to a crib rail or the like.

4. An action figure toy comprising:

a figure;

a housing including means to conceal the figure;

means connecting said figure to said housing for relative movement from a position of concealment of said figure to one of visibility of said figure;

means to move said figure slowly from said position of concealment to said position of visibility and to return it rapidly to said position of concealment;

wherein the connecting means includes a post supporting said figure in said housing; a pin fixed to said post; an actuating arm mounted on said housing having a first end connected loosely to said pin and means mounted on said housing to move said actuating arm about a pivot fixed to said housing and located adjacent a second end of said arm;

wherein the means to move said arm includes a crank, one end of which crank engages said arm and the other end of which engages a motor-driven music box;

wherein said arm includes a depression having a lower surface and said crank includes a finger which engages said lower surface whereby upon actuation of said music box said crank will drive said arm to thereby move said figure.

5. The toy of claim 4 wherein said figure both recpirocates and rotates as it is moved.

6. The toy of claim 4 including clamp means for securing said toy to a crib rail or the like.

* * * * *